US007467469B2

(12) United States Patent
Wall

(10) Patent No.: US 7,467,469 B2
(45) Date of Patent: Dec. 23, 2008

(54) MODULAR HOUSING SYSTEM AND METHOD OF MANUFACTURE

(76) Inventor: Harlin Wall, 974 Greenbriar Dr., State College, PA (US) 16801

( * ) Notice: Subject to any disclaimer, the term of this patent is extended or adjusted under 35 U.S.C. 154(b) by 65 days.

(21) Appl. No.: 11/516,661

(22) Filed: Sep. 7, 2006

(65) Prior Publication Data

US 2007/0051067 A1 Mar. 8, 2007

Related U.S. Application Data

(60) Provisional application No. 60/714,371, filed on Sep. 7, 2005.

(51) Int. Cl.

| | |
|---|---|
| ***B21D 47/00*** | (2006.01) |
| ***B21D 47/01*** | (2006.01) |
| ***E02D 35/00*** | (2006.01) |
| ***E04B 1/18*** | (2006.01) |
| ***E04H 12/00*** | (2006.01) |

(52) U.S. Cl. ..... 29/897; 29/897.2; 29/897.3; 29/897.312; 29/897.35; 29/783; 29/785; 52/122.1; 52/634; 52/650.1

(58) Field of Classification Search ..... 29/897, 29/897.3, 897.31, 897.312, 897.32, 897.33, 29/897.35, 771, 783, 785, 787, 791, 792, 29/795, 430, 822; 52/172.1, 634, 650.1, 52/122, 650.11

See application file for complete search history.

(56) References Cited

U.S. PATENT DOCUMENTS

| | | | | | |
|---|---|---|---|---|---|
| 2,125,692 | A | * | 8/1938 | Ragsdale et al. | 52/731.2 |
| 3,225,434 | A | * | 12/1965 | Van Der Lely et al. | 29/430 |
| 3,699,628 | A | * | 10/1972 | Gollobitz | 29/564.1 |
| 3,705,679 | A | * | 12/1972 | Tenpas | 228/49.2 |
| 5,749,256 | A | * | 5/1998 | Bodnar | 72/333 |
| 5,850,686 | A | * | 12/1998 | Mertes | 29/809 |

* cited by examiner

*Primary Examiner*—David P Bryant
*Assistant Examiner*—Alexander P Taousakis
(74) *Attorney, Agent, or Firm*—Wenderoth, Lind & Ponack, L.L.P.

(57) ABSTRACT

An edge beam construction including two vertical perforated rolled shapes with webs inverted toward the center of the beam, and a bottom track having a flange disposed in a vertical position against bottom lips of the vertical rolled shapes. The three basic components of the edge beam are positioned so as to provide access for press joining tools. A building module manufacturing method utilizes the light gauge steel rolled shapes that permit industrialized, automated manufacture of floor, roof and wall panels for modular housing and commercial structures with integrated mechanical and electrical systems and rigid framing for road transport without trailers. The module manufacturing method includes a novel method of constructing and positioning a gable.

10 Claims, 10 Drawing Sheets

MODULAR HOUSING SYSTEM AND METHOD OF MANUFACTURE

This application claims the benefit of U.S. Provisional Application No. 60/714,371, filed Sep. 7, 2005, the entire contents of which are incorporated herein by reference.

BACKGROUND OF THE INVENTION

1. Field of the Invention

The present invention relates to a novel method of industrial, automated manufacture of light gage steel floor, roof and wall panels, with exceptional energy properties, to form stronger building modules of varying width, height and length. The invention provides structures of one to four stories for homes, offices, motels, hotels and other cellular structures. The method also allows aesthetic flexibility for a wide range of products, from traditional family home designs to contemporary structures including large glass surfaced areas and spatial elements. The invention uses lighter weight materials; thereby reducing module weight by approximately 40% of modules produced by the current wood modular industry and significantly reduces shipping costs from the manufacturing plant to the erection site.

2. Description of the Related Art

The intent of the modular industry is to provide a finished, quality housing product in the shortest amount of time. However, the current modular industry has not yet achieved full integration of mechanical and utility services as part of an automated production system and is still reliant upon labor intensive technology, historic materials and outdated modes of structural framing. There is vast improvement possible in all stages of module construction, transport and erection.

In addition to requiring weeks to finish a typical 2,000 $ft^2$ house, the industry wastes time and money with outmoded transport methods. For instance, the major structural elements of modular construction are longitudinal members, which support transverse joists to create the floor panel of the module. The industry usually locates the members in either the field of the panel to allow the transverse joists to cantilever to the outside width dimension of the module or as a frame for floor panels with joists extended to the inside of perimeter wood beams that support the module during crane erection at the site. The second method requires expensive, heavy steel framed multi-axle transport trailers to limit damage to gypsum and other relatively soft interior finishes due to module flexion during transport.

Currently the industry standard is far from the ideal product of a complete module including integrated mechanical and utility services, full insulation and efficient use of materials. Although certain modular industry products approximate the ideal, the mainstream modular industry has developed without the structural, cost and aesthetic advantage of galvanized light gage steel rolled shapes and automated production technologies.

Despite the potential, light gauge steel has not historically been economical primarily due to difficult connection problems. The attachment of light gauge steel shapes to construct panels for modular structures, limited by national codes and conventions that adhere to historic structural configurations and fastening details, fails to take advantage of the inherent strength of light gauge steel materials. The galvanized surface that protects steel from rust and corrosion limits the use of welding attachment due to the toxic gas emitted during the welding process. The use of screw and nailing attachment of the members used to construct onsite structures is labor intensive and does not lend itself to either the multiple directions required of application tools in fastening multiple members or the creation of complex composite structural configurations needed to develop the strength capabilities of light gauge steel rolled shape members.

Recent advances in fastening technology promise an economical solution for jointing of light gauge steel. Press joining of light gage metals was introduced in Europe in the late 1980's, tested and proven, and since, tested and approved by most of the building codes in the United States. The activation of the press joint is fast, inexpensive and provides proven consistent joint strength for light gauge steel. However, the press joining tools, which can provide fastening of light gage galvanized steel sheets, are bulky and do not lend themselves to multi flexible positioning required for complex designs and difficult to reach members of complex composite designs. These problems must be solved before the press joining technology is introduced for automated module fabrication.

The historic structural configurations preferred and included in today's codes are based on labor intensive materials and hand held tools, which do not lend themselves to automation and the use of press joining fastening. Limited by current technology, the modular industry has not advanced beyond outdated models and modes of production. The object of the invention is to incorporate two technologies; light gage galvanized rolled structural shapes and the press joining technology, in an automated module manufacturing system by inventing new structural configurations and procedures which build upon the assets of each technology to create 21$^{st}$ century structures.

SUMMARY OF THE INVENTION

To accomplish automation in plant manufacture of light gage steel modular structures, it was necessary to invent structural combinations and configurations of standard light gage rolled shapes that provide the bulky press joining tools access to the members being joined for complete fastening of both single and multi light gage steel members. Understanding that this is not always possible, robotics provided with thermal force feedback (TFF) with resistance welding will supplement the press joining technology in areas of limited accessibility.

The invention uses floor panel edge beams herein referred to as EB's to achieve a triplicate function; mechanical & utility distribution, integral longitudinal structure to receive axles and wheels for shipping, and longitudinal edge beams for crane lifting and bolting and/or mechanically splicing the modules together to create a housing module.

Perforated rolled shapes used in both the transverse and longitudinal direction of the floor, ceiling, and roof panels, and the vertical exterior and marriage walls of the modules perform the multi-function of energy conservation and distribution of mechanical, plumbing, and electrical access to transfer services within and between the modules composing the structure. The invention reduces thermal conductance by employing standard multi-perforated open web rolled shapes manufactured by several companies to minimize energy transfer to and from the outside through the structural system. Also, the perforated rolled shapes offer connection points for transport assemblies, thereby eliminating the need for costly transport trailers.

BRIEF DESCRIPTION OF DRAWINGS

The foregoing and other objects of the invention will become more clear from the following detailed description of a preferred embodiment of the invention taken in conjunction with the drawings wherein.

DETAILED DESCRIPTION OF THE INVENTION

Figures 1A, 1B, 1C:
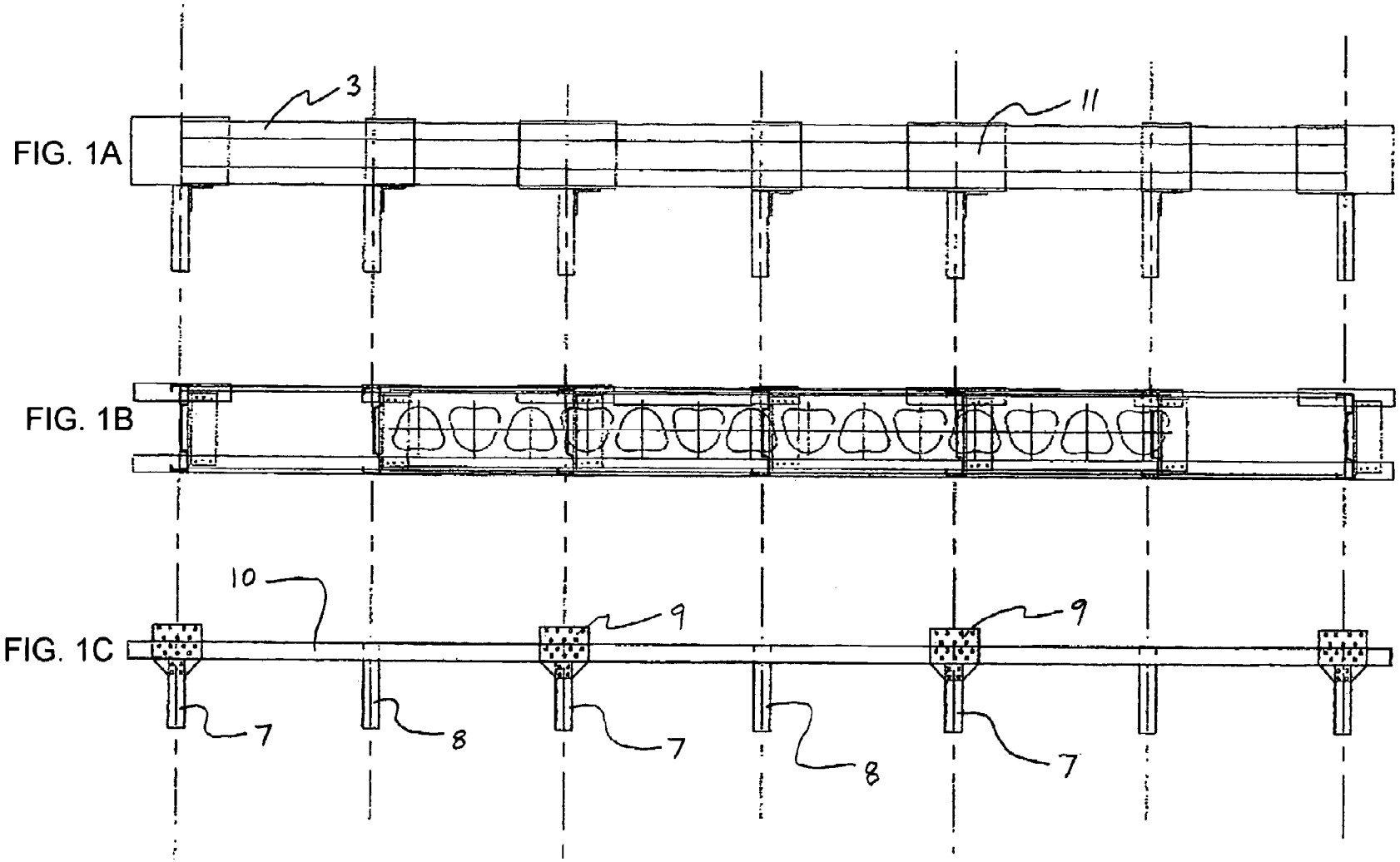
FIG. 1A is a top plan view of an edge beam constructed in accordance with the present invention.
FIG. 1B is a side view of the edge beam illustrated in FIG. 1A.
FIG. 1C is a side view showing the connections of load-bearing and non-load bearing studs to an edge beam.

As shown in FIGS. 1A to 1C, an edge beam (EB)(3) is constructed of two vertical perforated rolled shapes (1*a*, 1*b*) having webs that are inverted toward the center of the beam and one bottom track (2) having vertical flanges positioned against bottom lips of the vertical rolled shapes. The two vertical members and the bottom track compose a U-shaped edge beam (3) having an open top to permit the insertion of mechanical and utility distribution in the longitudinal and transverse edge beams of the modules. The two vertical perforated rolled shapes (1*a*, 1*b*) function as compression members of the edge beam.

The three basic components of the edge beam are positioned so as to provide access for the press joining tools. In particular, the construction of the edge beams permits automatic insertion of the tool head so that the bottom flanges of the compression members can be press joined directly to the web of the bottom track (2) along the full length of the edge beam at precise locations and frequency to develop the variable required shear loading resistance to bending moments of the edge beam.

Figure 2:
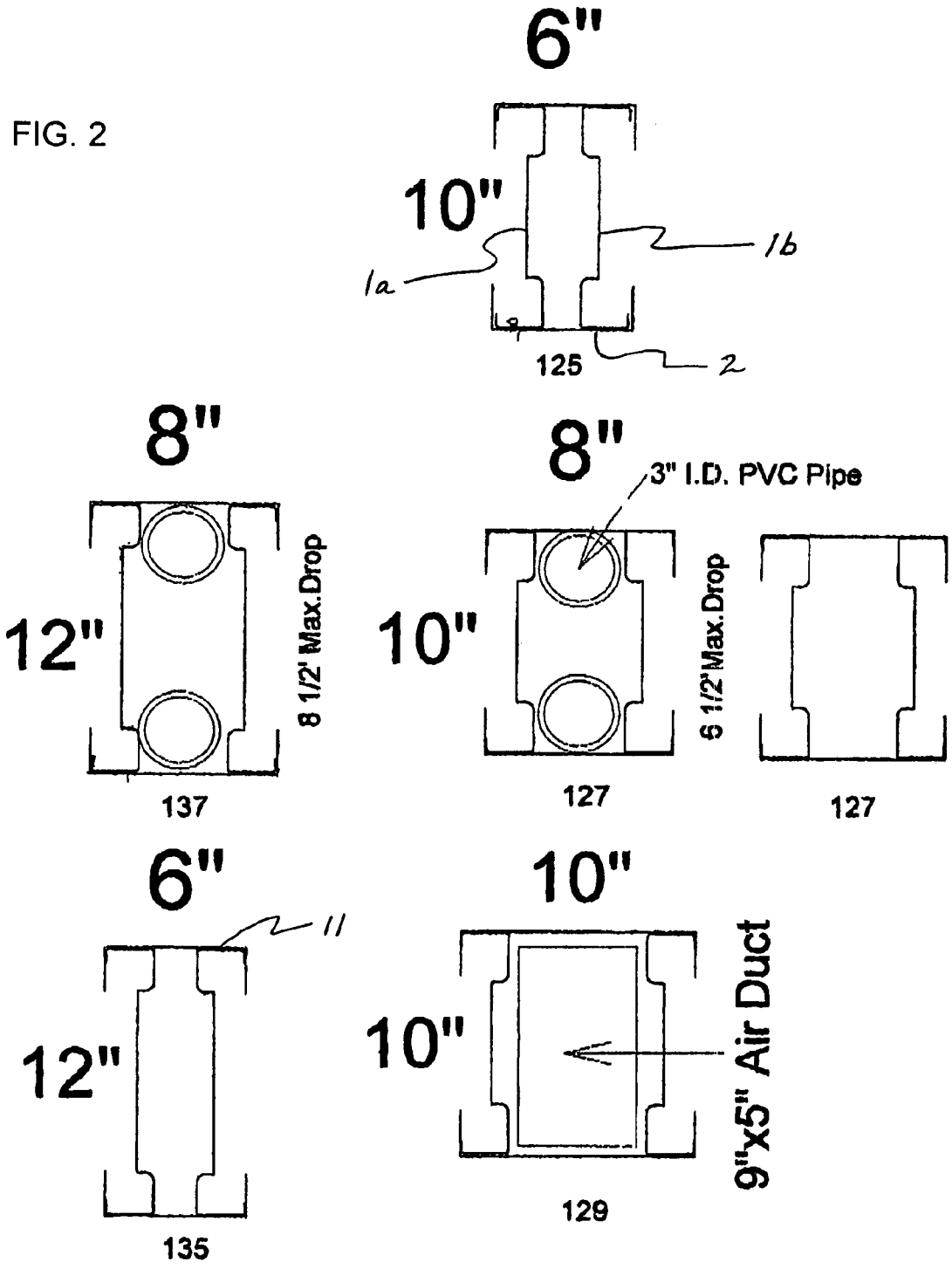
FIG. 2 shows sectional views of various edge beams taken at a connector.
Figure 7A:
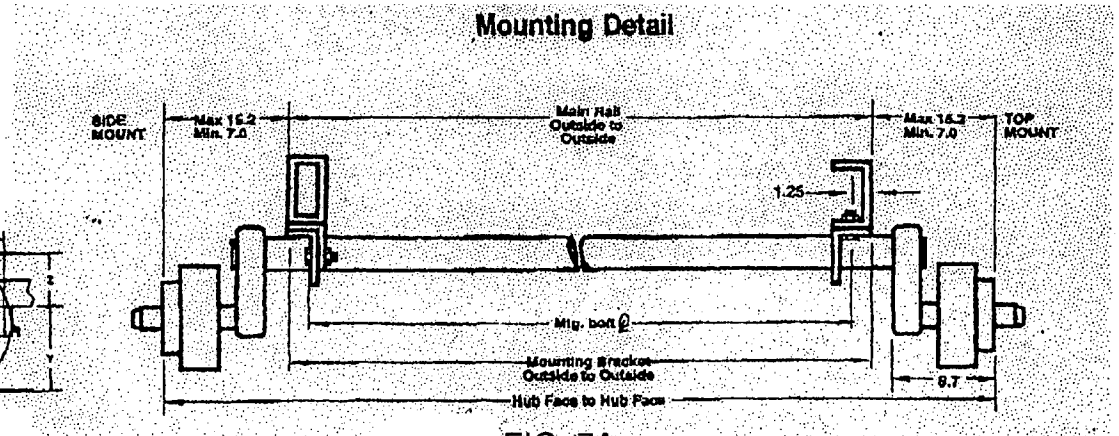
FIGS. 7A-C are schematic illustrations of transport assembly mounting details for attachment to a modular frame.
Figure 7C:
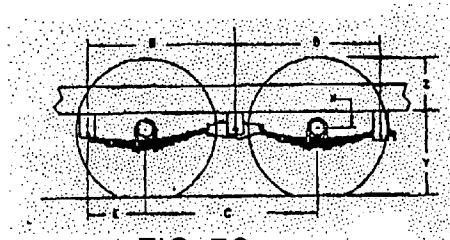
Figure 7B:
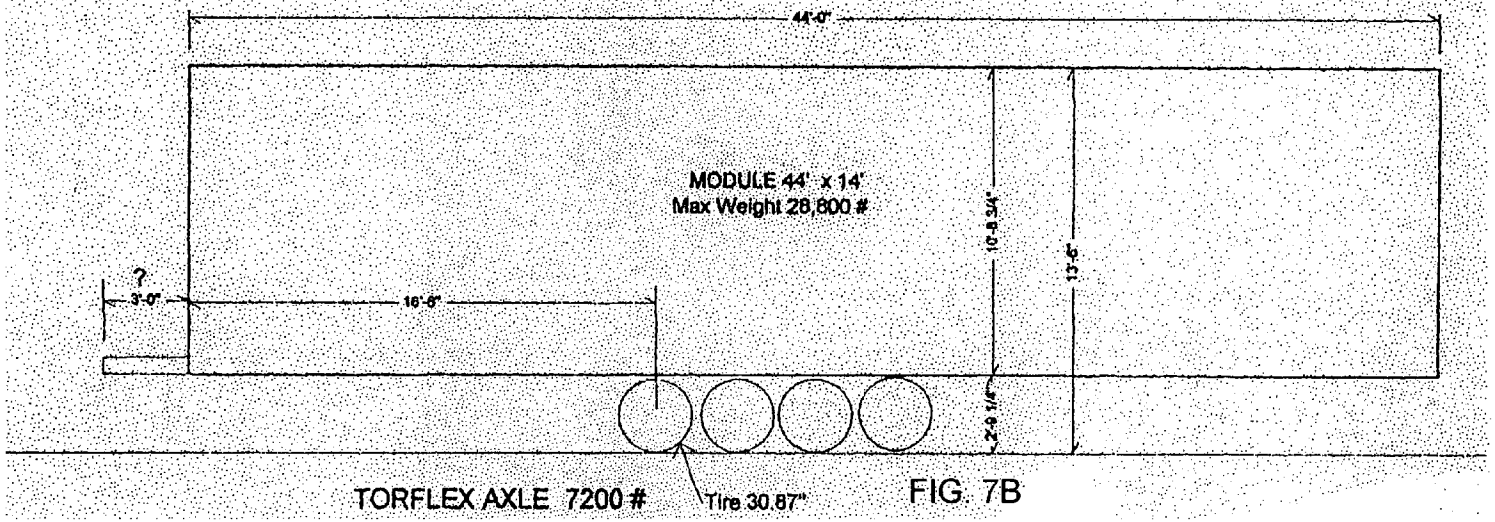

As shown in FIG. 2, the edge beam's depth can be varied from 6" to 14" and the width can be varied from 6" to 12" to accommodate various air duct sizes, required piping sizes, and drainage grades. The gages and lengths of the rolled shapes can be varied and connected by press joining and varying jointing of structural sections to accommodate varying stresses within the same edge beam, thereby matching selected gages to loading characteristics, minimizing the cost of steel materials and enabling handling of shorter structural sections. These factors necessarily result in varied structural cross sections of the edge beam, as seen in FIG. 2. The particular cross section of the edge beam is designed to match the required strength characteristics of the edge beam to the stress variations occurring in the edge beam for the various loads developed in the transporting frame assembly as seen in FIG. 7, the lifting strength required for setting modules, and the opening spans of the marriage and exterior walls. Note that the opening spans of the marriage and exterior walls can be reinforced with continuous vertical header beams to accommodate architectural open glazed (large glass areas) design and open architectural planning between modules.

Figure 3:
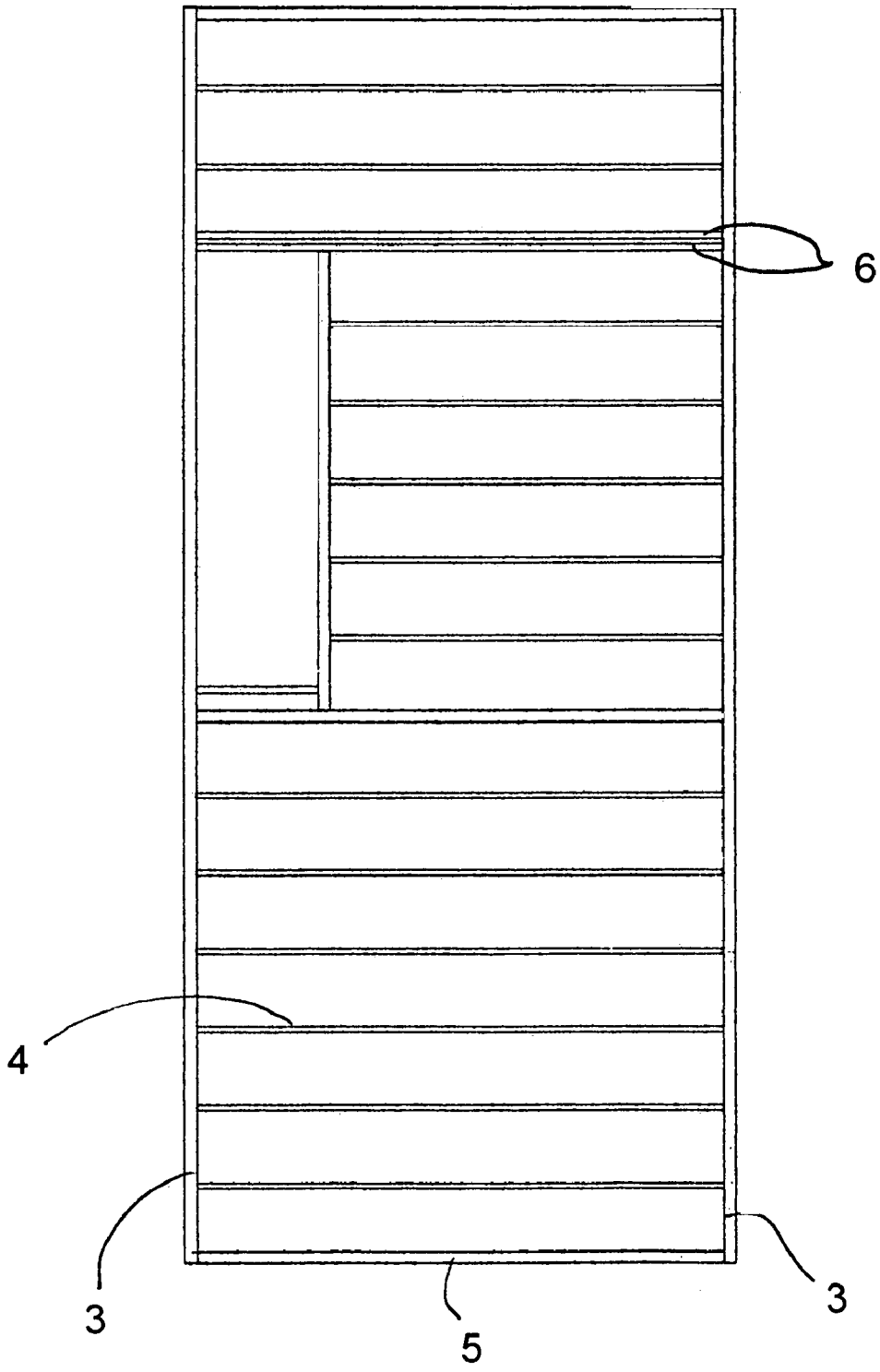
FIG. 3 is a plan view showing approximate edge beam and transverse member locations for a typical floor panel, similar to a typical ceiling panel framing scheme.
Figure 6A:
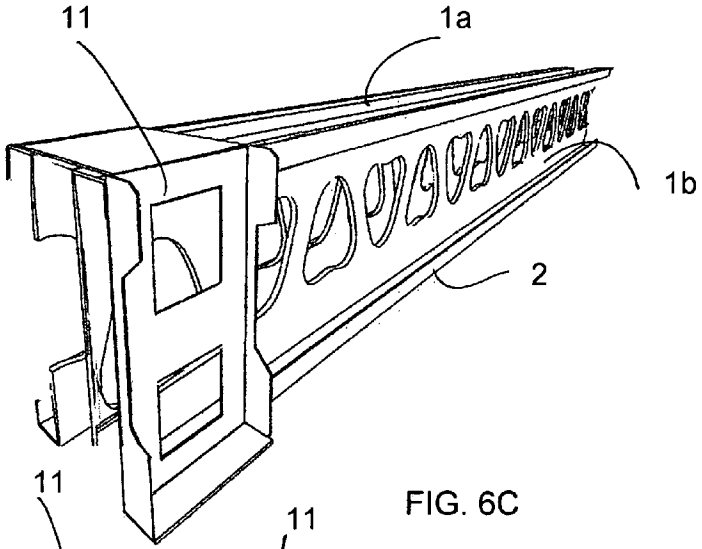
FIG. 6A is a perspective view of an edge beam provided with a light gauge steel framing connector.
Figure 6C:
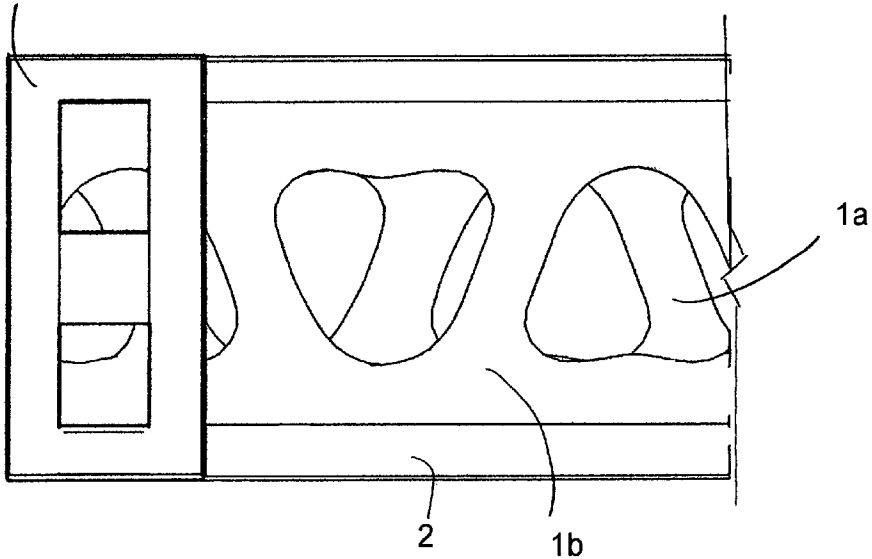
FIG. 6C is a side view of the edge beam and light gauge steel framing connector shown in FIG. 6A.
Figure 6B:
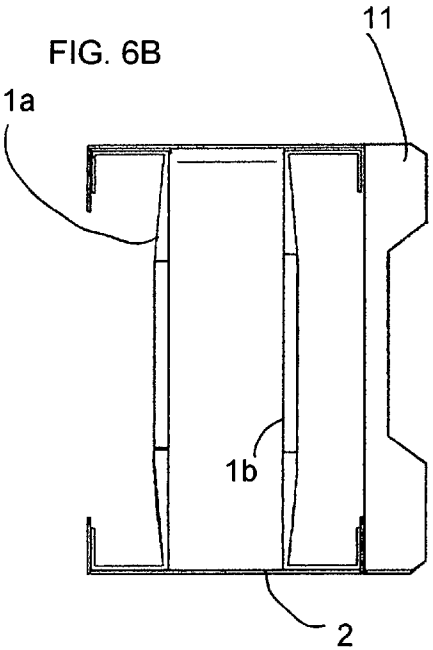
FIG. 6B is an end view of the edge beam and light gauge steel framing connector shown in FIG. 6A.

Floor panels (see FIG. 3), ceiling panels and roof panels are all framed in the transverse dimension between the edge beams of the panels with joist systems (4) 2"-0" on-center and supported with joist connectors or hangers (11) as shown in FIG. 6. The joist connectors extend across the top of the edge beams and are assembled by press joining to secure the vertical members of the edge beam in place. This arrangement ties the upper ends of the vertical members together. Intermediate beams (IB) (5) and double joists (6) are anchored in similar fashion with connectors (FIG. 6) of a width to accommodate the transverse members. The connectors (11) are shaped for automated placement by a carousel, and are installed as the panel advances in a 4 ft stepped motion. The connectors (11) are provided with openings or perforations for permitting mechanical and utility distribution to run from the interior of the edge beam through the openings and into the transverse member. Note that cutouts are provided in the sides of the connectors to provide access for robotic welders to connect the connectors to the transverse members.

Figure 4:
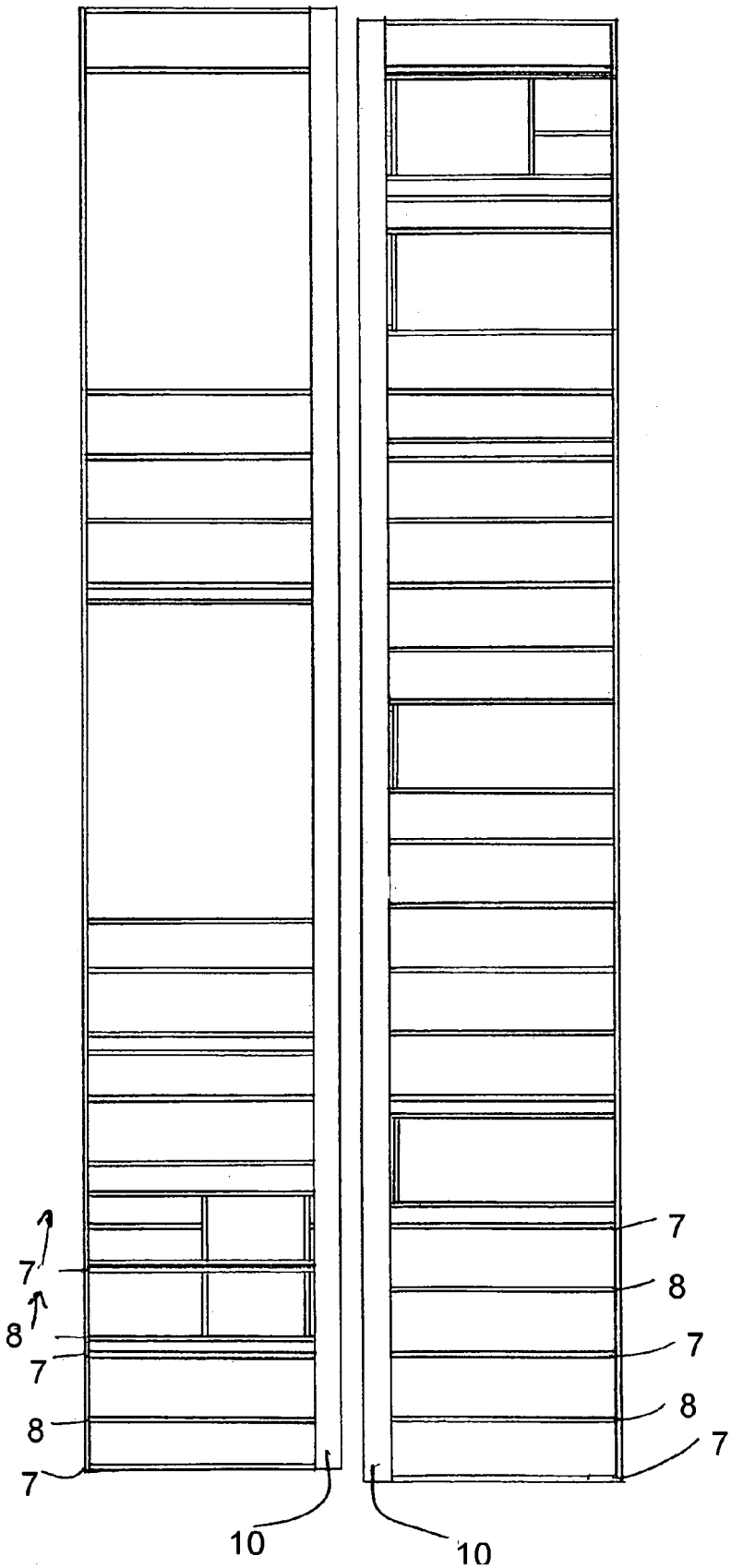
FIG. 4 is a plan view showing a typical exterior and marriage wall framing scheme.

The exterior and marriage wall panels (FIG. 4) are constructed of 6 inch minimum width wall studs of 20 gage galvanized steel and can be increased in width and gage as building heights or floor and roof loadings increase. In the exterior and marriage walls, major structural studs (7) repeat every 4'-0" on-center. The minor non-load bearing studs (8) are provided for sheathing stiffening and repeat an alternate 4'-0" on-center. All vertical loads of the modular structure are transferred to the foundation via the structural exterior and marriage wall structural studs (7).

As shown in FIG. 1C, the major structural studs (7) are strengthened with galvanized steel plates (9) at the top attachment to the wall panel's continuous header beam (10) and at the bottom attachment to the floor panel. The triangular shaped reinforcement plates are press joined to the studs during the structural fabrication of the wall panels. The bottom plates are screwed to the floor panels during the module panel erection.

The construction of the continuous exterior and marriage wall header beam (10) is similar to the edge beam and intermediate beam fabrication except for the intermittent bottom track, which allows the wiring harnesses and piping that has been inserted through the open top, to connect with electrical wiring and piping in the wall panels below during the module panel erection.

The continuous top wall header beam serves several unique functions including horizontal shear resistance supplemental to the wall sheathing materials in the exterior and marriage wall panels, provision for an open channel track for the insertion of metal assemblies to bolt and/or mechanically splice stacked modules together at varied locations as may be required structurally, and an open space for unforeseen mechanical and electrical systems.

The inversion of the two vertical perforated rolled shapes web members allows foamed insulation to permeate the perforations and isolate the steel web members from the inside surface of exterior and marriage wall sheathing material, thereby creating a nearly complete thermal break and insulation of the structure.

The invention employing innovative light gauge steel module framing techniques includes a method of automated manufacture. The method is possible through the use of a programmed computer driven automated system for module panel manufacture. The system directs the movement of equipment and material employed in the manufacturing process. The automated system is capable of placing every structural member, sheeting material and thermal insulation using the same manufacturing line to create floors, exterior and marriage walls, interior walls, ceilings, roofs and gables of varying lengths and widths in the order required for module assembly.

Figure 8:
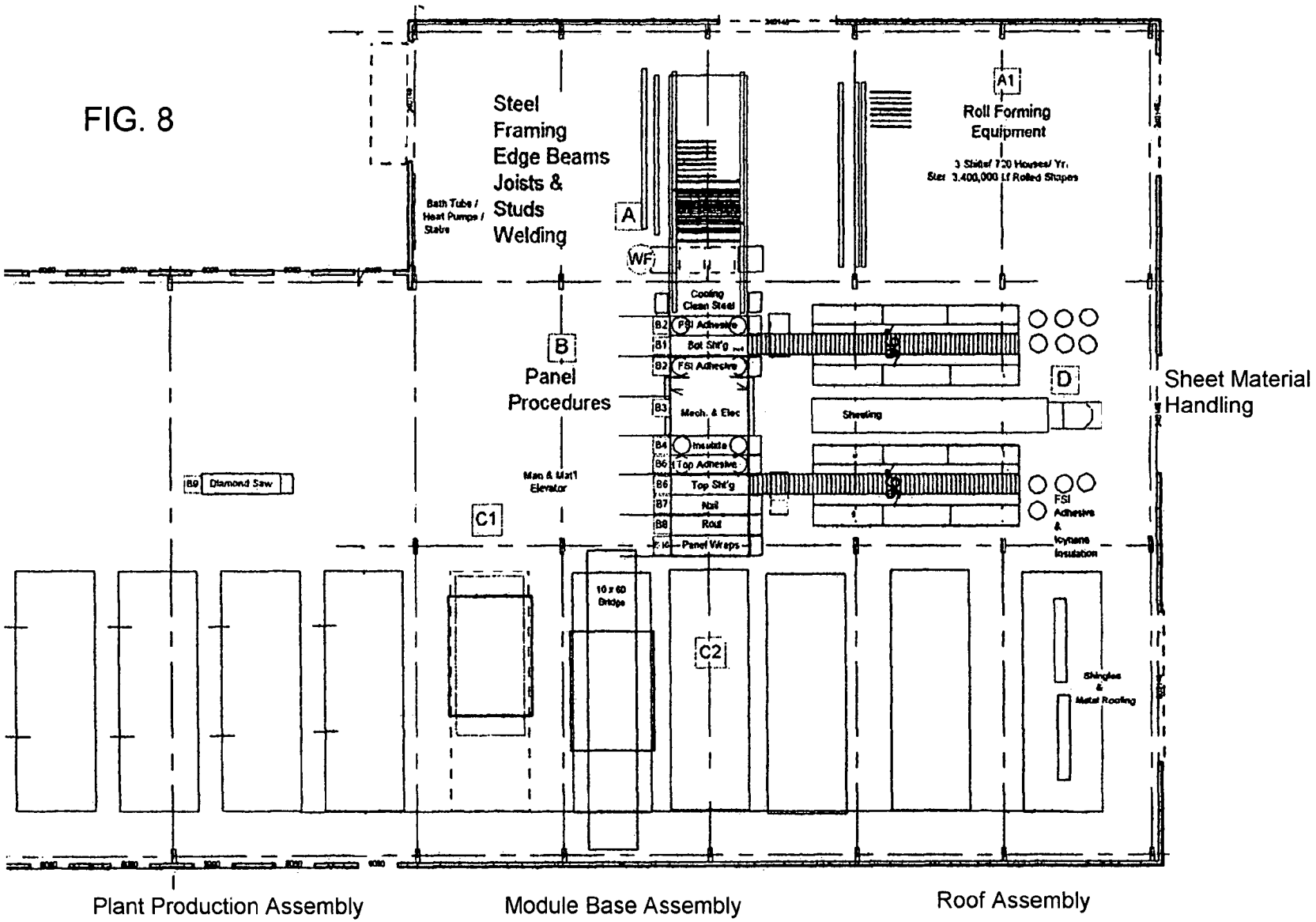
FIG. 8 is a drawing showing assigned areas in the plant for each production stage.
Figure 9:
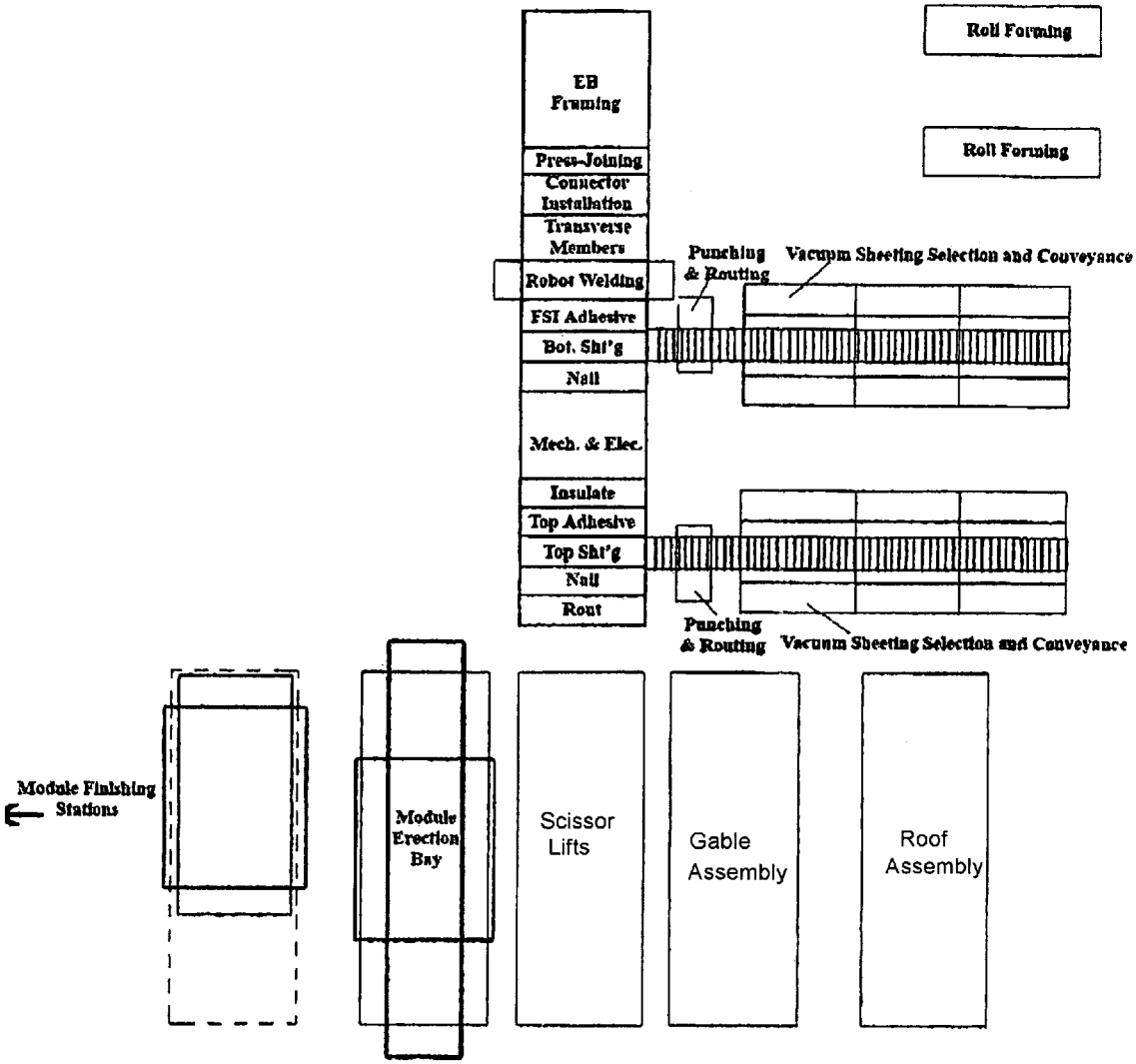
FIG. 9 is a drawing showing an overview of the plant layout.
Figure 10A:
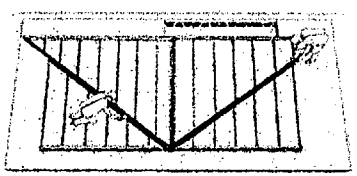
FIGS. 10A-K are a series of drawing figures illustrating a gable positioning procedure.
Figure 10B:
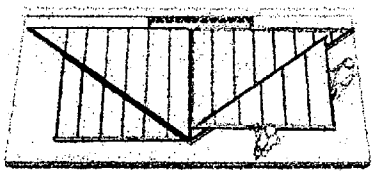
Figure 10C:
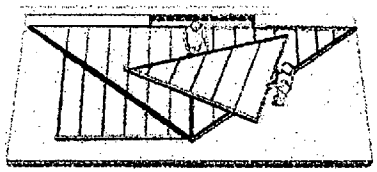
Figure 10D:
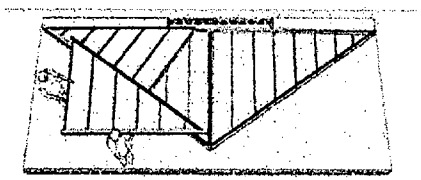
Figure 10E:
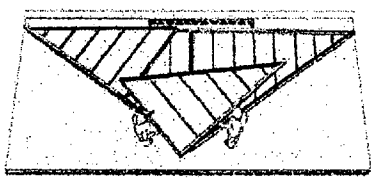
Figure 10F:
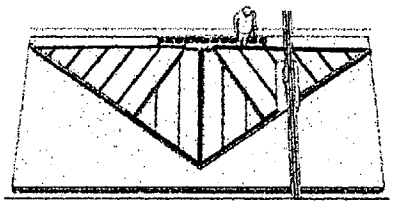
Figure 10G:
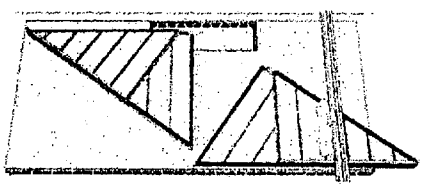
Figure 10H:
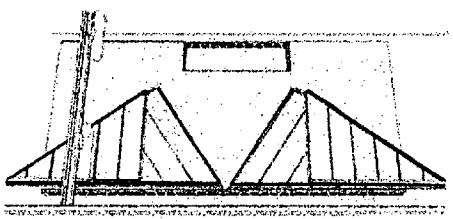
Figure 10I:
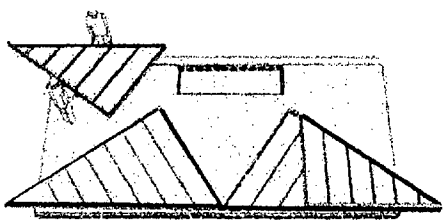
Figure 10J:
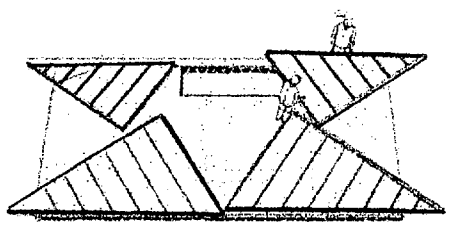
Figure 10K:
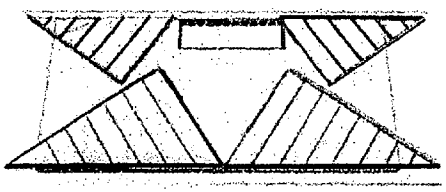

The automated manufacturing line (FIG. 8) advances the light gauge steel framing assembly four feet after the completion of each stage on the framing table and assembly line. The various stages of the manufacturing process are described below.

Stage (1): Steel Shapes Roll-Formed

In this stage flat steel is loaded into purchased steel roll-forming machinery to custom form and cut steel shapes in varied cross sections and lengths as needed. In addition, the roll-form machinery will cut access holes in the webs of the steel shapes as necessary. Alternatively, pre-formed transverse and longitudinal members can be purchased from existing companies.

Stage (2): Overhead Crane Lifts Steel Shapes onto Framing Table

During this stage the crane lifts the steel shapes that are necessary for edge beam construction of a particular panel and transports them to the framing table in preparation for the third stage.

Stage (3): Panel Edge Beam Members Loaded onto Line

In this stage the edge beam components (1*a*, 1*b*) are manually placed in the track (2) with the webs back-to-back, resulting in a placement of the components that is inverted relative to the typical box-beam member placement. This arrangement gives the press-joining equipment access to the various connection points. Alternatively, the loading of the edge beam components could be automated.

Stage (4): Edge Beam Components Press-Joined to Form Edge Beam Assembly

In this stage the flanges of edge beam members (1*a*, 1*b*) are press-joined to the web of the track (2).

Stage (5): Placement of Steel Connectors (11) Over Edge Beam Assembly

In this stage a carousel selects the appropriate width, depth and gauge hanger and drops it on top of the edge beam assembly as shown in FIG. 1A and in FIG. 6. Although providing proprietary access and fins for connection, the connector cradle design functions similarly to a joist hanger in conventional construction.

Stage (6): Placement of Transverse Members into Steel Connectors (11)

In this stage an overhead automated hopper system places the transverse framing members into the connector cradles from above. Alternatively, the transverse framing members could be placed manually.

Stage (7): Robots Weld Transverse Framing to Connectors

The fin of the connector and web of the transverse member are welded together at two points. Alternatively, smaller press-joining machinery could be developed to access and join the pieces.

Stage (8): Sheeting Conveyor and Vacuum Lifter Selects and Conveys Appropriate Sheeting Material In this stage a vacuum lifter on a moveable framework will select and vacuum transport one sheet of material from the material stack onto a conveyor system. The conveyor transports the material to the sheeting preparation machine in the ninth stage.

Stage (9): Material Advances Through Sheeting Preparation Machine:

In this stage the material is conveyed through the sheeting preparation machine and is punched and routed as required. As the material advances, adhesive is applied to the top of the sheeting in preparation for the tenth stage.

Stage (10): Sheeting Attached to the Bottom of Framing Members

In this stage the sheeting material is conveyed under the framing assembly and pressed up and adhesively joined to the framing members. In addition, fastening equipment such as automated screw guns or steel nail guns mechanically fasten the sheeting material to the framing members from below the panel plane.

Stage (11): Transfer of Frame with Bottom Sheeting to a Conveyor

The framing assembly with attached bottom sheeting is transferred to a conveyor system.

Stage (12): Installation and Pressure Testing of Pre-Assembled Mechanical and Utility Systems In this stage the mechanical and utility systems are fed through the holes in the transverse members and along the open edge beam channel from above. Once connections have been made between systems, the assembly is pressure tested for quality control.

Stage (13): Insulation Foamed into Structural Frame

In this stage the framing assembly, with attached lower sheeting and installed mechanical and utility systems, advances to a vapor control area and the void between members is insulated with expanding foam issued from nozzles mounted above the panel plane. The insulation can either be a soy "bio-based" formulation or a traditional foam product.

Stage (14): Application of Adhesive to Top of Steel Framing Members

Nozzles above the panel plane lay a bead or coating of adhesive on top of the exposed members in preparation for the fifteenth stage.

Stage (15): Installation of Top Sheeting

After selection by a vacuum lifter and passing through the sheeting preparation machine, as in stage 9, the sheeting material is lowered and pressed onto the adhesive applied in stage 14. In addition, mechanical fastening equipment such as automated screw or nail guns mechanically fastens the sheeting material to the framing members from above the panel plane.

Stage (16): Panel Advanced to Scissor Lift Supports

The scissor lift supports have a low-friction finish on a table top-like surface that allows the panel to slide into position.

Stage (17): Floor Panel Lowered on Scissor Lifts

In this stage the floor panel (FIG. 3), when complete, is lowered slightly on scissor lifts.

Stage (18): Manufacture of Module Walls

Figure 5:
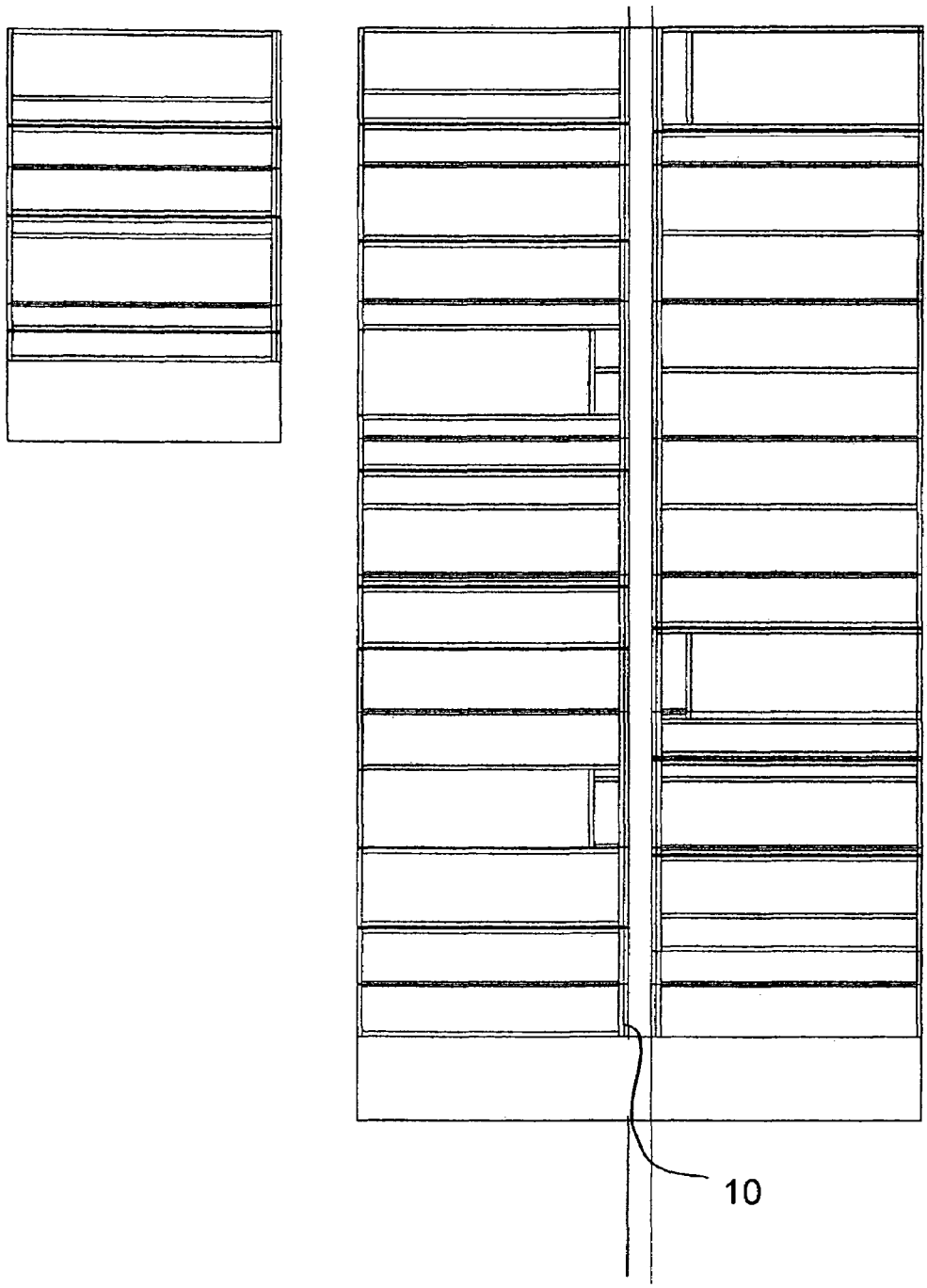
FIG. 5 is a plan view showing a typical interior wall framing scheme.

In this stage, the module walls (FIG. 5) are manufactured in a process similar to the above. The interior walls (FIG. 5) are manufactured together as one contiguous panel with top and bottom track web cut to length and flanges left uncut before stacking on top of floor panel. Exterior and marriage walls (FIG. 4) are manufactured similarly and stacked on top of the interior wall panels. The stack including floor panel, exterior and marriage wall panels, and interior wall panels is referred to as the module base stack (MBS).

Stage (19): Insertion of Air-Casters Under MBS

In the nineteenth stage, air casters are inserted under the module base stack.

Stage (20): Module Base Stack Manually Floated on Air Casters to the Module Base Erection Bay The module base erection bay contains an overhead hoist system, which is necessary for the twenty first and twenty second stages.

Stage (21): Installation of Exterior and Marriage Walls

In this stage, the overhead hoist system lifts and rotates the exterior and marriage wall panels into place before the wall framing is manually fastened, using screws or nails, to the floor panel using connection plates.

Stage (22): Installation of Interior Walls

In this stage the interior walls are raised as a panel before the track flanges are cut for each wall individually. The newly separated walls are then mechanically fastened to the structure as needed. The completed structure is referred to as the module base (MB).

Stage (23): Manufacture of Attic Floor, Gable and Roof Panels

Similar to stages 1-18 as described above, the attic floor, gable and roof panels are manufactured and stacked as an attic stack (AS) on the scissor lift supports. Also, the first floor ceiling panels are manufactured as single elements to complete first and intermittent floor modules.

Stage (24): Transport of the Attic Stack

In this stage the overhead crane transports the attic stack to the gable assembly bay. The gable assembly bay contains a large elevated work surface and a sliding and pivoting diamond-blade saw. The overhead crane lifts the roof panels from the attic stack and the roof panels are transported to the roof assembly bay. The roof assembly bay contains an elevated work surface, roofing materials and fastening equipment.

Stage (25): Assembly of the Roof

With the roof panels placed on the roof assembly bay elevated work surface, removable lifting hinges with integral crane loops are mechanically fastened to the panels. After installation of the lifting hinges, roofing materials, such as shingles or architectural metal and any necessary trim, are applied.

Stage (26): Cutting of Gable by 80%

While assembly of the roof occurs, the gable panel in the gable assembly bay (GAB) is cut 80% through with the diamond-blade saw. The cuts delineate the gable panel into four gable sections. The saw can be manually or automatically positioned for this stage.

Stage (27): Installation of Steel Angle in Gable Cuts

In this stage, steel angles are mechanically fastened with one leg of the angle perpendicular to the plane of the panel with the leg projecting into the cuts made in stage 26, and the other leg parallel to the plane of the panel resting on top of the sheeting material.

Stage (28): Application of Exterior Finish to Gable Sheeting and Installation of Attic Vent In this stage, an exterior finish, such as vinyl siding or a fiber-cement siding product, is mechanically fastened to the gable sheeting. Additionally, an attic vent and any specified trim is mechanically fastened to the gable sheeting.

Stage (29): Overhead Crane Lifts and Rotates the Gable Panel

In this stage the overhead crane lifts the gable panel and rotates the panel 180 degrees before replacing the gable panel on the attic floor panel. The gable panel sheeting, with the exterior surface applied, is now facing the floor with exposed framing facing the ceiling (upwardly).

Stage (30): Cutting Remaining 20% of Gable

In this stage the diamond-blade saw cuts through the remaining 20% of the gable panel, thereby separating the gable panel into four pieces (FIG. 10).

Stage (31): Installation of Steel Angle on Edges of Gable Pieces

Similarly to stage 27, steel angle is installed on the edges of the gable pieces.

Stage (32): Final Gable Positioning

As shown in FIG. 10, the four gable pieces are lifted, rotated, and moved into place by workers and the overhead crane.

Stage (33): Attic Stack Re-Compiled

In this stage, the overhead crane lifts and transports the roof panel to the gable and attic floor assembly bay and lowers the roof panel onto the positioned gable pieces.

Stage (34): Installation of Roof Rollers and Gable Hinges

In this stage, a roof roller apparatus that was patented by the present inventor (U.S. Pat. No. 6,705,051 B1) and roof hinges are mechanically fastened to the roof panel, gable pieces and attic floor panel. The disclosure of U.S. Pat. No. 6,705,051 is incorporated herein by reference.

Stage (35): Overhead Crane Transports and Lowers the Attic Stack

In this stage, the overhead crane lifts the attic stack and transports it to the module erection bay. The module erection bay is as described in Stage 20. The overhead crane lowers the attic stack onto the assembled module base which was constructed in stages 21 and 22.

Stage (36): Assembly of the Module

In this stage, the attic stack is mechanically fasten to the module base and the mechanical and utility connections are hooked up between wall, floor and roof panels.

Stage (37): Assembled Module Advanced to Finishing Stations

In this stage, the assembled module is pushed on air casters to typical finishing stations for remaining exterior finishes, interior wall and floor finishes, cabinetry, plumbing and electric fixture installation and finish trim. Alternatively, the module advance could be accomplished automatically.

Stage (38): Finished Module Ready for Transport Assembly Mounting and Shipment

The module is referred to as a finished module after completion of stages 1-37 and is now ready to be placed on a transport assembly and provided with a module cover, which provides temporary surface protection during shipment. The module is now ready to be shipped.

The novel module construction utilizes a light gauge steel framing system that incorporates press joining and robot welding of light gauge metals. The structure and process accommodates the multi-directional orientations required of application tools to fasten multiple members. The process is capable of producing complex composite structural configurations that utilize the strength capabilities of light gauge steel rolled shape members.

It is intended that the invention be defined by the claims appended hereto, and their equivalents.

I claim:

1. A building module manufacturing method comprising:

forming a plurality of perforated steel edge beams, wherein each of the edge beams is formed by placing and connecting a pair of vertical members in a bottom track;

placing, via a carousel, transverse connectors over the edge beams;

placing transverse members in the transverse connectors to form a structural member, wherein the transverse members are placed with an overhead dispenser;

fixing the transverse members in the transverse connectors;

selecting and placing lower sheeting with a vacuum lift material delivery system for transport to a sheeting preparation machine;

transporting the lower sheeting to the sheeting preparation machine;

performing routing, punching and glue application on the lower sheeting as the lower sheeting passes through the sheeting preparation machine;

conveying the lower sheeting under the structural member and pressing the lower sheeting upward; and adhering the lower sheeting to the structural member and mechanically fastening the lower sheeting from below to form a panel.

2. The building module manufacturing method as claimed in claim 1, further comprising:

inserting pre-assembled mechanical and utility assemblies into the structural member;

pressure testing the structural member after the pre-assembled mechanical and utility assemblies are inserted therein;

insulating the structural member with expanding foam insulation; and applying top sheeting with a vacuum lift material delivery system from above the structural member to form a panel.

3. The building module manufacturing method as claimed in claim 2, further comprising sliding the panel onto scissor lifts provided with a low-friction sliding surface.

4. The building module manufacturing method as claimed in claim 3, further comprising:

constructing a gable from the panel including cutting the panel approximately 80% through, rotating the panel, and cutting the remaining 20% of the panel through to form a plurality of gable sections;

relocating the sections to a final shipping position; and attaching, via hinges, the gable sections to roof panels.

5. The building module manufacturing method as claimed in claim 4, further comprising erecting a roof using removable and reusable roof hinges that include integral crane connections for raising the roof on-site.

6. The building module manufacturing method as claimed in claim 5, further comprising forming interior walls, exterior wall, and marriage walls as contiguous panels, and separating the contiguous panels immediately prior to installation.

7. The building module manufacturing method as claimed in claim 1, wherein the bottom track is formed of steel and has vertical flanges interconnected with a horizontal web.

8. The building module manufacturing method as claimed in claim 7, wherein each of the vertical members is formed of steel and is perforated, and the vertical members are connected to the bottom track by press joining.

9. The building module manufacturing method as claimed in claim 7, wherein:

each of the vertical members has a vertical web projecting in a direction toward a center of the edge beam, a top flange, a bottom flange, and a lip projecting from a longitudinal edge of said bottom flange, and the top and bottom flanges are interconnected by the vertical web.

10. The building module manufacturing method as claimed in claim 1, the transverse members are formed of steel, and are fixed in the transverse connectors by press-joining and robotic welding.

* * * * *